US011382465B1

(12) United States Patent
Lyness

(10) Patent No.: US 11,382,465 B1
(45) Date of Patent: Jul. 12, 2022

(54) PORTABLE APPARATUS FOR HEATED SHOWERS

(71) Applicant: Adam Ramsay Lyness, Christchurch (NZ)

(72) Inventor: Adam Ramsay Lyness, Christchurch (NZ)

( * ) Notice: Subject to any disclaimer, the term of this patent is extended or adjusted under 35 U.S.C. 154(b) by 0 days.

(21) Appl. No.: 17/204,993

(22) Filed: Mar. 18, 2021

(51) Int. Cl.

| | |
|---|---|
| ***A47K 3/32*** | (2006.01) |
| ***F24H 1/06*** | (2022.01) |
| ***A47K 3/40*** | (2006.01) |
| *A47K 3/30* | (2006.01) |

(52) U.S. Cl.
CPC ..... *A47K 3/325* (2013.01); *A47K 3/40* (2013.01); *F24H 1/06* (2013.01); *A47K 2003/307* (2013.01)

(58) Field of Classification Search
CPC .... A47K 3/325; A47K 3/40; A47K 2003/307; F24H 1/06
USPC ..... 4/599
See application file for complete search history.

(56) References Cited

U.S. PATENT DOCUMENTS

| | | | | |
|---|---|---|---|---|
| 2,567,506 A * | 9/1951 | Bowman | A47K 3/284 4/603 |
| 3,431,565 A * | 3/1969 | Nelson | A47K 3/325 4/598 |
| 5,111,538 A * | 5/1992 | Chapman | F24H 1/06 4/603 |
| 6,929,002 B1 * | 8/2005 | Adrian | F24H 1/06 220/521 |
| 2007/0193576 A1 * | 8/2007 | Hughes | F24C 13/00 126/513 |

* cited by examiner

*Primary Examiner* — Huyen D Le

(57) ABSTRACT

A portable apparatus for heated showers for bathing in the outdoors that converts a hiking stove for use as a water heater for a portable shower. The apparatus includes a flexible plastic lid for sealing a hiking stove pot, allowing water to be pumped from a reservoir bucket to the stove pot and back again via silicone tubes connected to the plastic lid, and heating the reservoir water when the stove flame is ignited. The bucket contains a circulation pump, a temperature probe, and a second, larger, pump connected to a shower nozzle via a silicone tube. A control unit powers the immersed pumps and enables shower temperature selection.

6 Claims, 4 Drawing Sheets

PORTABLE APPARATUS FOR HEATED SHOWERS

FIELD OF THE INVENTION

The present invention relates generally to a portable apparatus for heated showers. Particularly, but not exclusively, the invention relates to a portable apparatus for heated showers for bathing in the outdoors that converts a hiking stove for use as a water heater for a portable shower. The apparatus includes a flexible plastic lid for sealing a hiking stove pot, allowing water to be pumped from a reservoir bucket to the stove pot and back again via silicone tubes connected to the plastic lid, and heating the reservoir water when the stove flame is ignited. The bucket contains a circulation pump, a temperature probe, and a second, larger, pump connected to a shower nozzle via a silicone tube. A control unit powers the immersed pumps and enables shower temperature selection.

BACKGROUND OF THE INVENTION

Several types of showers have been utilized for bathing in the outdoors. Typically, these take the form of solar showers, consisting of a large black water bag and an attached nozzle that can be hung off a tree, with the water heated through solar radiation. This design, while simple, suffers from several shortcomings, including the need for the shower to be left in bright sunshine for several hours to heat. This creates a dependency on sunlight, making the device only suitable for use on sunny days in warm temperatures, as well as a very long shower interval to heat batches of water between showers. Moreover, shower pressure is very low due to being limited by the height the water bag can practically be mounted.

Another solution utilized in the outdoors is a continuous gas heater. These work by pumping water from a reservoir through a metal coil, which is heated by a gas burner, thus transferring heat to the water. Heated water flows directly through the coil to a shower nozzle. This design suffers from the shortcoming that flow rate is limited by the instantaneous heat that can be generated by the burner, meaning the apparatus is bulky and heavy in order to create a good shower experience with high flow rate. None of these designs are suitable for inclusion in a hiking backpack due to their large size and weight.

An additional solution provides a large metal container that can be filled with water and heated directly on a stove or fire. This design is again bulky and heavy and not suitable for carrying long distances in a backpack.

Therefore, a need exists for a highly compact, lightweight apparatus suitable for inclusion in a hiking backpack that can deliver a hot, high pressure shower on-demand, without requiring long periods in the sun or bulky, heavy equipment.

SUMMARY OF THE INVENTION

According to a first aspect of the invention, there is provided a portable apparatus for heated showers by providing a continuous flow of hot water for immediate use, the apparatus comprising:

a stove configured to be compact and portable;

a pot configured to be compact and portable;

a lid configured to form a hermetic seal on said pot with said lid having a water inlet tube and a water outlet tube;

a water reservoir having at least one opening fluidly connected to the water inlet tube and water outlet tube;

a water circulation pump configured to circulate water between the reservoir and the pot via the water inlet tube and outlet tube;

a control unit with water temperature gauge configured to control the water circulation pump to transfer heated water from the stove to the reservoir and indicate when the water in the reservoir has reached a pre-determined temperature;

a shower pump configured to transfer water from the reservoir to a shower nozzle via a shower tube;

whereby when a user fills the reservoir and ignites the stove and the water in the reservoir has reached a pre-determined temperature, a user is notified to turn off the stove by the control unit and activate the shower pump in order to have a warm shower.

According to a second aspect of the invention, there is provided a method for using a portable apparatus for heated showers by providing a continuous flow of hot water for immediate use, comprising the steps of:

providing a stove configured to be compact and portable;

providing a pot configured to be compact and portable;

providing a lid configured to form a hermetic seal on said pot with said lid having a water inlet tube and a water outlet tube;

providing a water reservoir having at least one opening fluidly connected to the water inlet tube and water outlet tube;

providing a water circulation pump configured to circulate water between the reservoir and the pot via the water inlet tube and outlet tube;

providing a control unit with water temperature gauge configured to control the water circulation pump to transfer heated water from the stove to the reservoir and indicate when the water in the reservoir has reached a pre-determined temperature;

providing a shower pump configured to transfer water from the reservoir to a shower nozzle via a shower tube;

whereby when a user fills the reservoir and ignites the stove and the water in the reservoir has reached a pre-determined temperature, a user is notified to turn off the stove by the control unit and activate the shower pump in order to have a warm shower.

Preferably, the lid is comprised of a plastic material which is configured to soften as the temperature of the water increases thereby enabling the lid to dislodge if the water temperature exceeds a pre-determined threshold.

Preferably, the control unit is configured to indicate that the water in the reservoir has reached a pre-determined temperature and the water in the stove has reached a pre-determined higher temperature, whereby when a user has turned off the stove, the water circulation pump is activated periodically in order to transfer the water from the stove to the reservoir in order to maintain the temperature of the water in the reservoir at a pre-determined temperature.

More specific features for preferred embodiments are set out in the description below.

BRIEF DESCRIPTION OF THE DRAWINGS

The invention will now be described by way of example only with reference to the accompanying drawings, in which.

DETAILED DESCRIPTION OF THE INVENTION

Various embodiments of the present invention are described hereinafter with reference to the figures. It should be noted that the figures are only intended to facilitate the description of specific embodiments of the invention. In addition, an aspect described in conjunction with a particular embodiment of the present invention is not necessarily limited to that embodiment and can be practiced in any other embodiments of the present invention.

The present invention relates generally to a portable shower apparatus.

Figure 1:
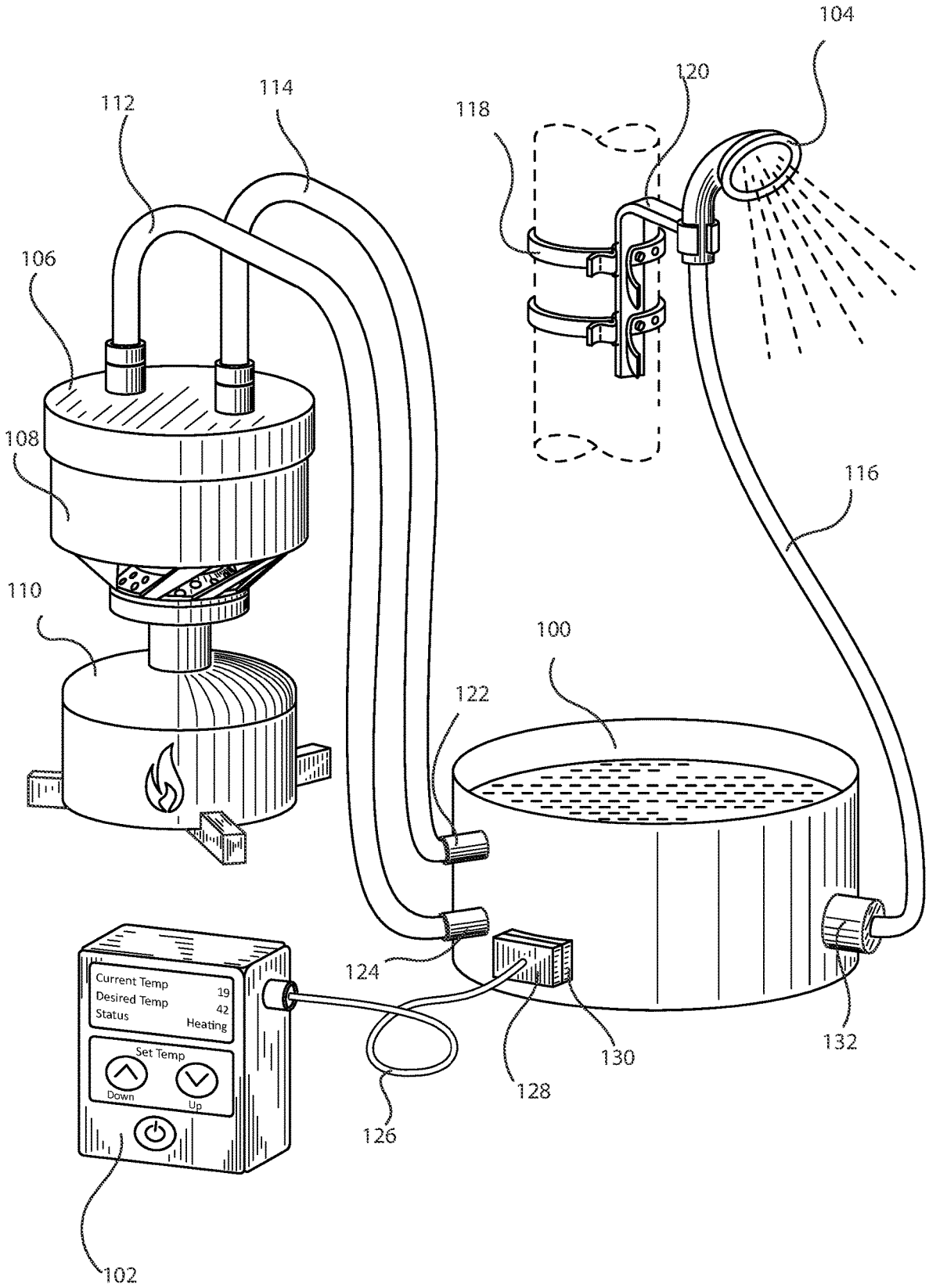
FIG. 1 shows a perspective view of one embodiment of the invention, with the apparatus fully assembled.

FIG. 1 shows a perspective view of one embodiment of the invention, with the apparatus fully assembled.

A foldable fabric reservoir bucket 100 is preferably of 20 litre capacity and made of waterproof siliconized nylon fabric. An electronic control unit 102 enables the user to set the desired water temperature, receive an audible notification when desired temperature is reached, and start and stop flow to a shower nozzle 104, via silicon shower tube 116, preferably of 10 mm outer diameter. A strop 118 is wrapped around a landscape feature at the desired height and tightened, and the shower nozzle 104 is attached to the strop 118 via bracket 120. The control unit 102 attaches to the reservoir bucket 100 via cable 126 and connectors 128, 130.

A pot sealing assembly is supplied to fit a cooking pot 108 for a commercial off-the-shelf 'Integrated Canister' type hiking stove 110. The pot sealing assembly consists of a lid 106, preferably made from flexible TPU plastic, used to create a watertight seal around the pot 108 with connection points for silicon hoses 112, 114 (preferably 6 mm outer diameter) for circulating water through the pot 108 from the reservoir bucket 100.

Figure 2:
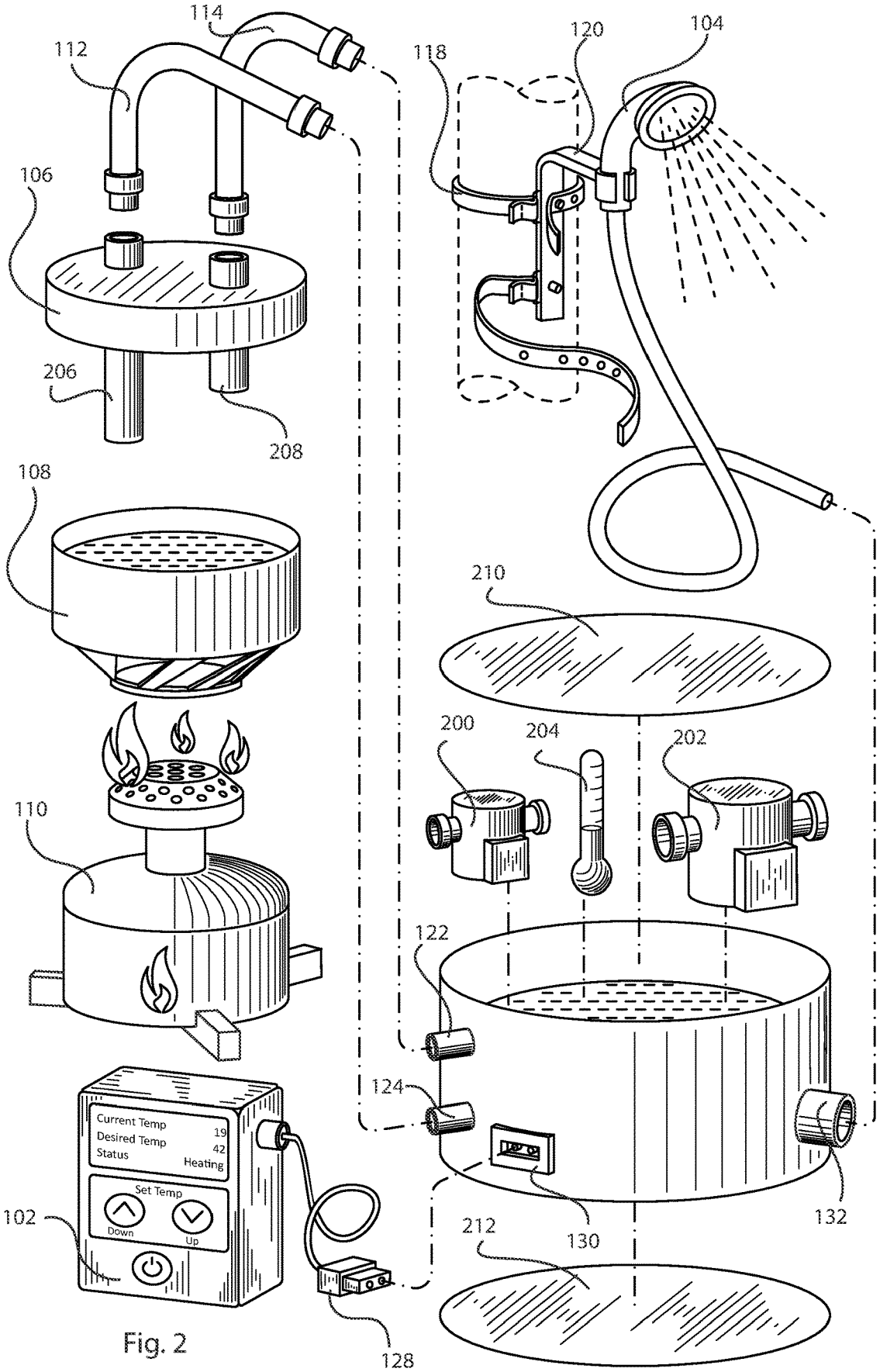
FIG. 2 shows an exploded perspective view of the apparatus shown in FIG. 1.

FIG. 2 shows an exploded perspective view of one embodiment of the invention. The control unit 102 has an LCD display to provide the user with visual data, push-buttons to receive user input, a buzzer to provide audible alerts, and contains a rechargeable lithium battery (not shown) for powering the control unit 102 and water pumps 200, 202.

The cable 126 connects the control unit 102 to a submersible temperature probe 204, preferably of NTC thermistor type, situated in the reservoir bucket 100. The control unit 102 also connects to a low voltage submersible heated water circulation pump 200, preferably of 5 watts power, and preferably capable of generating at least 1 meter of head with a flow rate of 2 litres per minute, used to circulate water from the reservoir bucket 100 through the heating assembly 106, 108, 110 via silicon tubes 112, 114.

In addition, the control unit 102 also connects to a low voltage submersible shower pump 202, preferably of 20 watts power, and capable of generating at least 4 meters of head with a flow rate of 10 litres per minute, used to pump heated water from the reservoir bucket to the shower nozzle 104 via the silicon shower tube 116.

A neoprene lid 210, preferably 2 mm thick, is intended to float on the surface of water in the reservoir bucket 100 to reduce convective and conductive heat loss. A neoprene base 212, preferably 2 mm thick, is attached to the underside of the reservoir bucket to reduce conductive heat loss. A submersible temperature probe 204, preferably of NTC thermistor type, is connected to the control unit 102. Water inlet 206 and outlet tubes 208 are integrated with the pot lid 106 to complete a pot sealing assembly.

Figure 3:
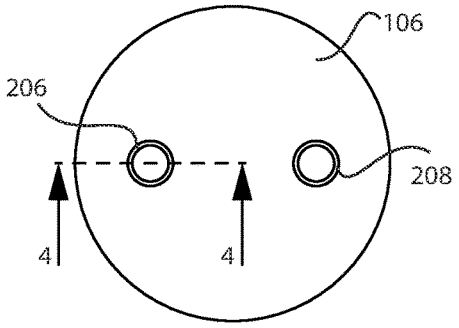
FIGS. 3 and 4 show a top plan view and fragmentary side sectional view of the lid assembly for sealing the hiking stove pot.
Figure 4:
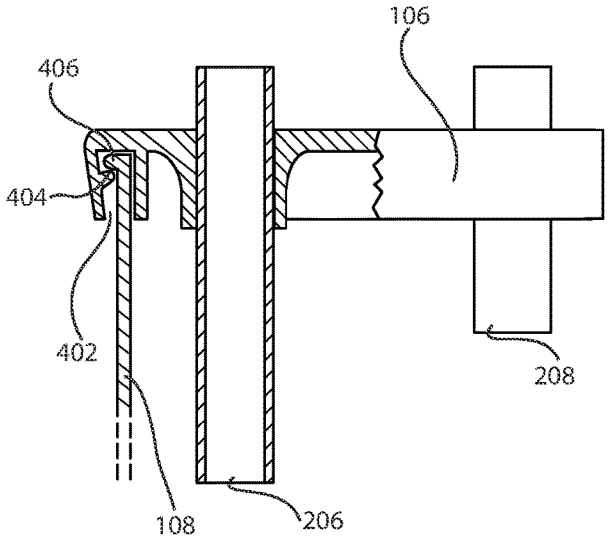

FIGS. 3 and 4 show a top plan view and fragmentary side sectional view of the pot sealing assembly consisting of a flexible lid 106, and water inlet 206 and outlet tubes 208 enabling water to be circulated through the pot 108. The left side of the fragmentary sectional view in FIG. 4 shows the lid slot 402 and ridge 404 designed to firmly hold the lid 106 to the rim 406 of the pot 108 and create a watertight seal.

Figure 5:
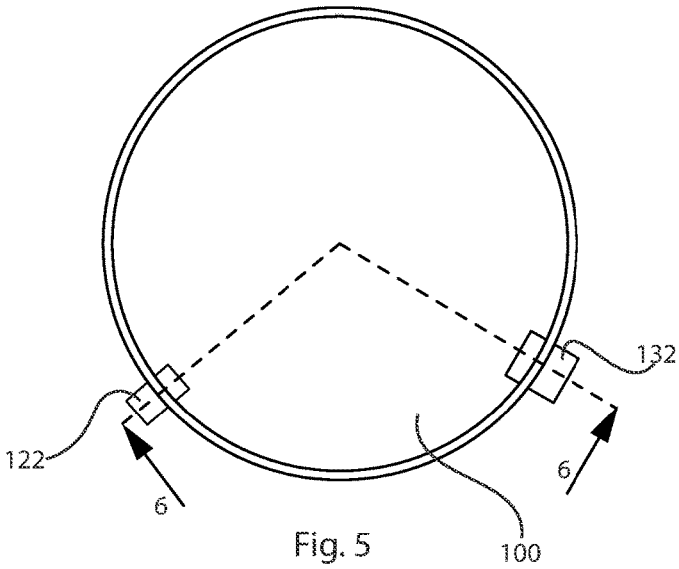
FIG. 5 shows a plan view of the water reservoir bucket.

FIG. 5 shows a plan view of the water reservoir bucket 100 with water heater circulation hose connector 122 and shower nozzle connector 132 visible.

Figure 6:
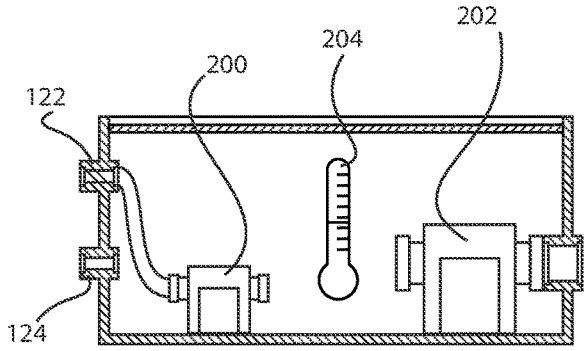
FIG. 6 is a side sectional schematic view of the reservoir bucket, with water heater circulation pump, shower pump and temperature probe visible.

FIG. 6 is a side sectional schematic view of the reservoir bucket, with water heater circulation pump 200, shower pump 202 and temperature probe 204 visible.

Figure 7:
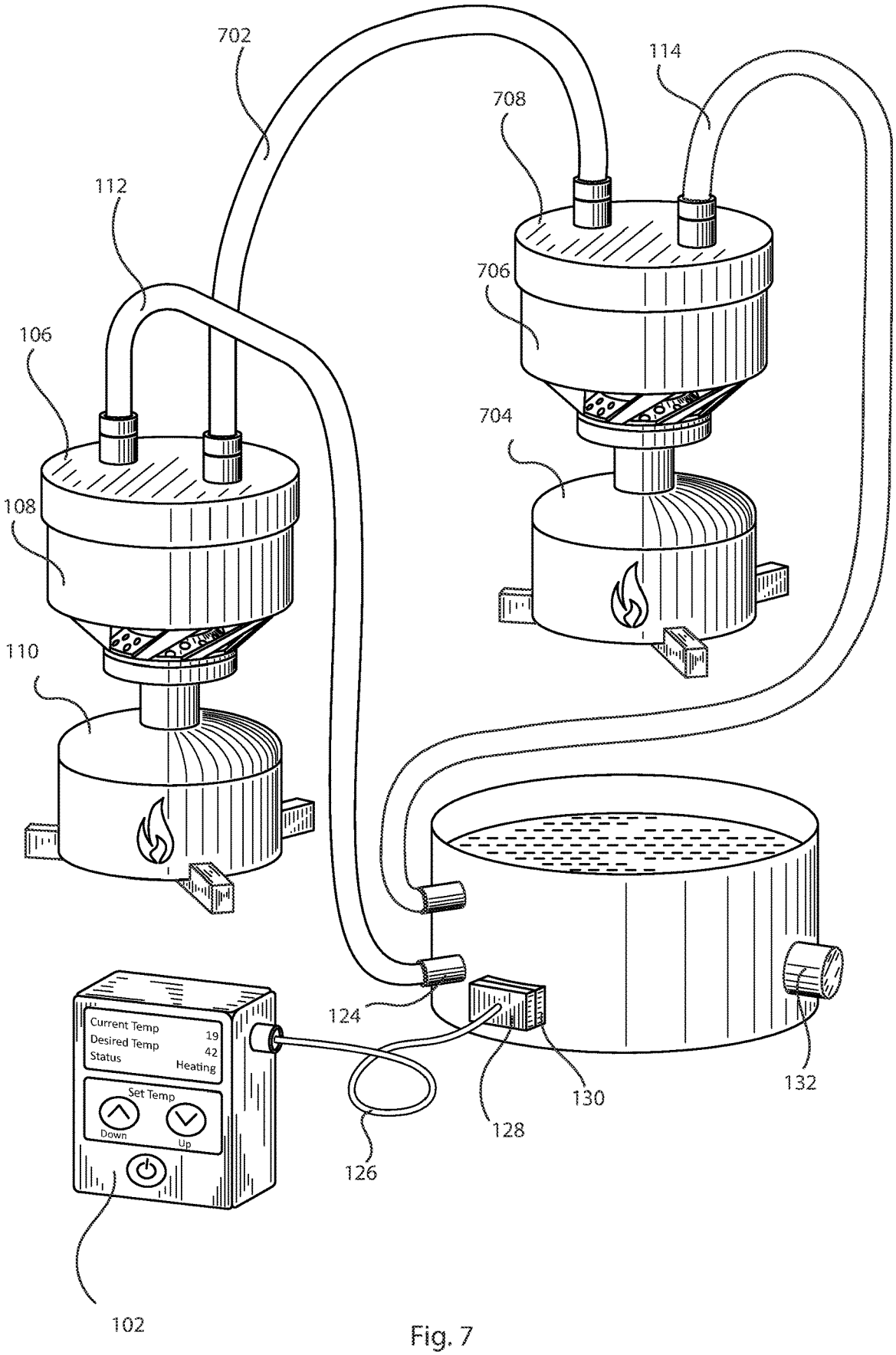
FIG. 7 shows an alternative embodiment of the invention, with two heating assemblies connected in series to achieve a higher rate of water heating.

FIG. 7 shows an alternative embodiment of the invention, with two stoves connected in series to achieve a higher rate of water heating. In the dual stove embodiment, another silicon hose 702, is added to enable water to circulate through a second heating assembly comprising a stove 704, pot 706 and lid 708, and through a silicon hose 114 to the reservoir.

The operation of the invention will now be discussed.

By converting a standard commercial hiking stove (which most hikers will be carrying anyway) to a circulatory water heater, an effective portable shower can be created while adding minimal additional size and weight (less than 1.2 kg) to a hiker's load. Accordingly, the invention provides a light and compact apparatus enabling a hot, high pressure shower on-demand.

Hiking stoves do not have high enough heat output to instantaneously heat cold water to typical shower temperatures of 40-44 degrees Celsius while maintaining a useful flow rate. For this reason, this invention is designed to heat a reservoir of water over time. For a typical hiking stove this will take 10-15 minutes for approximately 15 litres of water, depending on heat output of stove, ambient temperature, and temperature increase required.

Users wanting a shower will first fill a lightweight fabric reservoir bucket 100 from a nearby water source and then position the bucket adjacent to a convenient feature for mounting the shower nozzle 104, such as a tree.

Setup then proceeds according to the configuration shown in FIG. 2:

- A strop (118) is wrapped around the feature at the desired height and tightened, and the shower nozzle 104 is attached to the strop.
- A pot sealing assembly consisting of a lid 106, inlet tube 206, and outlet tube 208 is attached to the stove pot 108 of a commercial gas hiking stove 110 to seal the stove pot 108 and create a water heating assembly consisting of the stove 110, stove pot 108 and pot sealing assembly 106, 206, and 208.
- Silicone water tubes 112, 114, 116 are used to connect the reservoir bucket 100 with the heating assembly and the shower nozzle 104.
- A control unit 102 is connected to the reservoir bucket which will activate the unit, start water circulating through the heating assembly, and enable the user to set the desired shower temperature.

Once the temperature is set the user will be prompted to ignite the gas stove 110 to commence water heating.

In order to heat the reservoir, water is circulated from the reservoir bucket 100 to the stove's pot 108 and back again, while the stove 110 is operating. Over time, this will heat the water in the reservoir to a suitable temperature for showering, without user intervention.

The invention uses a pot sealing assembly consisting of a lid 106 with water inlet 206 and outlet 208 tubes, enabling the hiking stove 110 to a operate as a circulatory water heater. The lid 106 is designed to ensure a watertight seal around the pot and can be sized to work with any pot with a raised ridge around the rim, providing the ability to create a tight seal. Advantageously, the 'sealed lid' completes a water heating assembly without the need to drill inlet and outlet holes in the side of the pot or make any other modifications that would impact the stove's primary use for food heating. Users can simply remove the lid after they have finished showering and return to using the stove for cooking.

Water is circulated between the reservoir bucket 100 and heating assembly 106, 108, 110 by a small circulation pump 200 submerged in the reservoir bucket 100. As shown in in FIG. 7, two heating assemblies can be connected in series to achieve twice the rate of water heating.

When the reservoir water reaches the desired temperature set by the user the control unit 102 will detect this using a temperature probe 204 in the reservoir bucket and stop the circulation pump 200. The water remaining in the stove pot 108 is heated for another 45 seconds to increase its temperature to approximately 65 degrees Celsius. The control unit 102 then beeps several times to alert the user and indicate they should turn off the stove burner 110. At this point the shower can be used, with the user able to start and stop a secondary (more powerful) shower pump 202 using the control unit 102.

Water in the reservoir bucket 100 will cool naturally over the duration of the shower, with the rate mostly dependent on ambient temperature. Preferably, the controller 102 uses the residual reservoir of hotter water in the stove pot 108 to maintain the shower temperature at the desired level by continuously measuring reservoir water temperature 204 and pulsing the circulation pump 200 as required. When the user has finished their shower, the reservoir 100 can be refilled, and the process repeated.

When the circulation pump 200 is activated, approximately 0.025 Bar of pressure is created within the sealed stove pot 108 by the water inlet tube 206, which forces an identical volume of heated water out the outlet tube 208 and back to the reservoir bucket 100. To avoid being dislodged by the pump pressure within the pot, the flexible plastic lid includes a ridge 404 to curve around the rim 406 of the stove pot 108. When under pressure due to the action of the water circulation pump 200 the flexible lid 106 will bow upwards slightly, which will have the effect of drawing the ridge 404 inwards and increasing contact pressure between the pot rim 406 and ridge 404, preventing the lid 106 from dislodging or leaking (see FIG. 4).

The lid 106 is made from TPU plastic (or another type of suitable thermoplastic), which softens as temperature increases. In the event of a pump failure it is possible for the water in the pot to reach boiling point. In this eventuality the increased water temperature will soften the plastic lid 106 enabling it to dislodge under minimal pressure to reduce the hazard from hot water and pressurised steam.

Advantageously, the invention provides a heating assembly whereby an existing commercial hiking stove can be used, without permanent modification, to heat a reservoir bucket filled with a large volume of water over time by circulating water between the reservoir 100 and the stove pot 108, while the stove 110 is operating. Water is heated directly in the hiking stove pot 108; there is no coil for heat transfer as would be found with conventional califont gas water heaters. Not using a coil lowers size and weight, increases thermal efficiency, and allows a user's existing hiking stove and burner to be used as a core element for the heating assembly without modification, further reducing the additional bulk and weight a hiker must carry in order to enjoy an effective shower.

Advantageously, a reservoir of hot water (greater than the desired shower temperature) is created in the sealed stove pot by continuing burner operation for a short time after the circulation pump is stopped. Water in the reservoir bucket will cool naturally over the duration of the shower, with the rate mostly dependent on ambient temperature. The residual reservoir of hotter water in the stove pot 108 is used to maintain the shower temperature at the desired level by continuously measuring reservoir water temperature 204 and pulsing the circulation pump 200 to add hot water to the reservoir bucket as required.

A secondary powerful shower pump 202 is combined with a smaller circulation pump 200 to enable water flow to the shower nozzle 104 to occur simultaneously with pulsed circulation pump operation.

Advantageously, it is quite common for a hiking party to carry more than one stove, enabling two heating assemblies to be connected in series and enabling more rapid heating for the purpose of a shower, as shown in FIG. 7.

While the invention has been illustrated and described in detail in the foregoing description, such illustration and description are to be considered illustrative or exemplary and non-restrictive; the invention is thus not limited to the disclosed embodiments. Features mentioned in connection with one embodiment described herein may also be advantageous as features of another embodiment described herein without explicitly showing these features. Variations to the disclosed embodiments can be understood and effected by those skilled in the art and practicing the claimed invention, from a study of the disclosure and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A portable apparatus for heated showers by providing a continuous flow of hot water for immediate use, the apparatus comprising:

a stove configured to be compact and portable;

a pot configured to be compact and portable;

a lid configured to form a hermetic seal on said pot with said lid having a water inlet tube and a water outlet tube;

a water reservoir having at least one opening fluidly connected to the water inlet tube and water outlet tube;

a water circulation pump configured to circulate water between the reservoir and the pot via the water inlet tube and outlet tube;

a control unit with water temperature gauge configured to control the water circulation pump to transfer heated water from the stove to the reservoir and indicate when the water in the reservoir has reached a pre-determined temperature;

a shower pump configured to transfer water from the reservoir to a shower nozzle via a shower tube;

whereby when a user fills the reservoir and ignites the stove and the water in the reservoir has reached a pre-determined temperature, a user is notified to turn off the stove by the control unit and activate the shower pump in order to have a warm shower.

2. The portable apparatus of claim 1, wherein the lid is comprised of a plastic material which is configured to soften as the temperature of the water increases thereby enabling the lid to dislodge if the water temperature exceeds a pre-determined threshold.

3. The portable apparatus of claim 1, wherein the lid of the control unit is configured to indicate that the water in the reservoir has reached a pre-determined temperature and the water in the stove has reached a pre-determined higher temperature, whereby when a user has turned off the stove, the water circulation pump is activated periodically in order to transfer the water from the stove to the reservoir in order to maintain the temperature of the water in the reservoir at a pre-determined temperature.

4. A method for using a portable apparatus for heated showers by providing a continuous flow of hot water for immediate use, comprising the steps of:

providing a stove configured to be compact and portable;

providing a pot configured to be compact and portable;

providing a lid configured to form a hermetic seal on said pot with said lid having a water inlet tube and a water outlet tube;

providing a water reservoir having at least one opening fluidly connected to the water inlet tube and water outlet tube;

providing a water circulation pump configured to circulate water between the reservoir and the pot via the water inlet tube and outlet tube;

providing a control unit with water temperature gauge configured to control the water circulation pump to transfer heated water from the stove to the reservoir and indicate when the water in the reservoir has reached a pre-determined temperature;

providing a shower pump configured to transfer water from the reservoir to a shower nozzle via a shower tube;

whereby when a user fills the reservoir and ignites the stove and the water in the reservoir has reached a pre-determined temperature, a user is notified to turn off the stove by the control unit and activate the shower pump in order to have a warm shower.

5. The method of claim 4, wherein the lid is comprised of a plastic material which is configured to soften as the temperature of the water increases thereby enabling the lid to dislodge if the water temperature exceeds a pre-determined threshold.

6. The method of claim 4, wherein the lid of the control unit is configured to indicate that the water in the reservoir has reached a pre-determined temperature and the water in the stove has reached a pre-determined higher temperature, whereby when a user has turned off the stove, the water circulation pump is activated periodically in order to transfer the water from the stove to the reservoir in order to maintain the temperature of the water in the reservoir at a pre-determined temperature.

* * * * *